US010132214B2

(12) United States Patent
Hioka

(10) Patent No.: US 10,132,214 B2
(45) Date of Patent: Nov. 20, 2018

(54) VALVE DEVICE FOR INTERNAL COMBUSTION ENGINE

(71) Applicant: TOYOTA JIDOSHA KABUSHIKI KAISHA, Toyota-shi (JP)

(72) Inventor: Eiichi Hioka, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 145 days.

(21) Appl. No.: 15/501,099

(22) PCT Filed: Jul. 31, 2015

(86) PCT No.: PCT/IB2015/001294
§ 371 (c)(1),
(2) Date: Feb. 1, 2017

(87) PCT Pub. No.: WO2016/020736
PCT Pub. Date: Feb. 11, 2016

(65) Prior Publication Data

US 2017/0254236 A1 Sep. 7, 2017

(30) Foreign Application Priority Data

Aug. 4, 2014 (JP) ..... 2014-158959

(51) Int. Cl.
*F01L 13/00* (2006.01)
*F01L 1/26* (2006.01)
(Continued)

(52) U.S. Cl.
CPC ..... *F01L 13/0063* (2013.01); *F01L 1/267* (2013.01); *F01L 1/185* (2013.01); *F01L 1/46* (2013.01)

(58) Field of Classification Search
CPC ... F01L 1/185; F01L 1/267; F01L 1/46; F01L 13/0063
(Continued)

(56) References Cited

U.S. PATENT DOCUMENTS 7,540,266 B2 * 6/2009 Tsuzuki ..... F01L 1/34 123/345
2001/0023674 A1 * 9/2001 Shimizu ..... F01L 13/0021 123/90.18
(Continued)

FOREIGN PATENT DOCUMENTS

JP 2001-263015 A 9/2001
JP 2006-132350 A 5/2006
(Continued)

OTHER PUBLICATIONS

International Search Report dated Dec. 9, 2015, in PCT/IB2015/001294, filed Jul. 31, 2015.

*Primary Examiner* — Jorge Leon, Jr.
(74) *Attorney, Agent, or Firm* — Oblon, McClelland, Maier & Neustadt, L.L.P.

(57) ABSTRACT

A valve device for an internal combustion engine (1) includes a camshaft (16), a cam (17), a control shaft (15), an input arm (14), a first rocker arm (13*a*), a second rocker arm (13*b*), a first valve (603*a*), a second valve (603*b*), and a slider (18). The input arm (14) is configured such that a cam torque of the cam (17) is transmitted thereto. The slider (18) is configured to allow the input arm (14) to be supported by the control shaft (15). The slider (18) is configured to support the first rocker arm (13*a*) in a power transmittable manner such that the cam torque transmitted to the input arm (14) is transmitted to the first rocker arm (13*a*). The slider (18) includes a torsion portion (23) configured to connect the first rocker arm (13*a*) with the second rocker arm (13*b*) such
(Continued)

that the cam torque transmitted to the first rocker arm (13*a*) is transmitted to the second rocker arm (13*b*) via the torsion portion (23).

4 Claims, 5 Drawing Sheets

(51) Int. Cl.
*F01L 1/46* (2006.01)
*F01L 1/18* (2006.01)

(58) Field of Classification Search
USPC ..... 123/90.15, 90.2, 90.27, 90.4, 90.44
See application file for complete search history.

(56) References Cited

U.S. PATENT DOCUMENTS

2003/0075126 A1* 4/2003 Asakura ..... F01L 1/34 123/90.15
2004/0250792 A1* 12/2004 Mizobuchi ..... F01L 13/0063 123/322
2005/0247278 A1* 11/2005 Koshimizu ..... F01L 1/022 123/90.16
2005/0274343 A1* 12/2005 Nakano ..... F01L 1/053 123/90.16
2007/0056565 A1* 3/2007 Fuwa ..... F01L 13/0063 123/481
2007/0137629 A1* 6/2007 Hamada ..... F01L 13/0063 123/673
2007/0163523 A1* 7/2007 Miyazato ..... F01L 1/022 123/90.16
2009/0293824 A1* 12/2009 Hwang ..... F01L 1/2405 123/90.16
2010/0012062 A1* 1/2010 Nakamura ..... F01L 1/185 123/90.18
2011/0107989 A1* 5/2011 Ohsawa ..... F01L 13/0026 123/90.15
2013/0239918 A1* 9/2013 Nakagawa ..... F02D 41/0002 123/90.15

FOREIGN PATENT DOCUMENTS

JP 2007-332886 A 12/2007
JP 2013-96344 A 5/2013

* cited by examiner

VALVE DEVICE FOR INTERNAL COMBUSTION ENGINE

BACKGROUND OF THE INVENTION

1. Field of the Invention

The present invention relates to a valve device for an internal combustion engine.

2. Description of Related Art

In a conventional valve device described in Japanese Patent Application Publication No. 2001-263015 (JP 2001-263015 A), for example, each cylinder is conventionally provided with an arm assembly constituted by a roller arm and two rocker arms formed separately, and positioning of the roller arm and the rocker arms of the each cylinder is adjusted by inserting respective shims having different thicknesses into a cylinder head and a carrier appropriately.

Conventionally, in an internal combustion engine provided with a valve device, it is widely known that a lift timing difference is caused between two intake valves so as to shift their valve-opening timings from each other and to generate a desired swirl flow, thereby improving combustion efficiency. Further, as a general valve device, a configuration, as described in JP 2001-263015 A, in which two rocker arms formed separately and two intake valves lifted along with pivoting of respective rocker arms is widely known. In a variable valve device described in JP 2001-263015 A, if the two rocker arms can pivot with a desired timing difference, it is possible to obtain a desired swirl flow as described above. Here, one of conceivable means for causing a plurality of rocker arms formed separately to pivot with a desired timing difference is that adjusters such as shims are inserted into the rocker arms so as to position the rocker arms, respectively, so that their pivoting timings are shifted from each other.

SUMMARY OF THE INVENTION

However, the valve device has a machine difference in a component constituting the arm assembly including the rocker arms. In order to perform the above positioning, it is necessary to adjust the arm assembly of each cylinder each time. Accordingly, in the conventional valve device, the number of manufacturing steps increases due to positioning of each cylinder and it is necessary to prepare various types of shims, which increases the number of components.

The present invention provides a valve device for an internal combustion engine which valve device allows a plurality of rocker arms to pivot with a desired timing difference, with a simple structure.

A valve device for an internal combustion engine, according to one aspect of the present invention, includes a camshaft, a cam, a control shaft, an input arm, a first rocker arm, a second rocker arm, a first valve, a second valve, and a slider. The cam is provided in the camshaft. The control shaft is provided as a shaft different from the camshaft. The control shaft is placed in parallel with the camshaft. The input arm is configured such that a cam torque of the cam is transmitted thereto. The first valve is configured to be opened and closed along with pivoting of the first rocker arm. The second valve is placed in the same cylinder as the first valve is placed. The second valve is configured to be opened and closed along with pivoting of the second rocker arm. The slider is configured to allow the input arm to be supported by the control shaft. The slider is configured to support the first rocker arm in a power transmittable manner such that the cam torque transmitted to the input arm is transmitted to the first rocker arm. The slider includes a torsion portion configured to connect the first rocker arm with the second rocker arm such that the cam torque transmitted to the first rocker arm is transmitted to the second rocker arm via the torsion portion. According to the above aspect, the cam torque transmitted to the input arm is transmitted to the first rocker arm connected to the input arm in a power transmittable manner, and then transmitted to the second rocker arm via the torsion portion. Hereby, the cam torque is transmitted with torsion of the torsion portion, so a timing difference in pivoting occurs between the first rocker arm and the second rocker arm. Accordingly, it is not necessary to use an adjuster such as a shim in order to cause such a timing difference in pivoting between the first rocker arm and the second rocker arm. As a result, it is possible to cause a difference in pivoting between the first rocker arm and the second rocker arm at a desired timing with a simple structure. Further, in the valve device according to the above aspect, the first rocker arm and the second rocker arm may be provided in the same axis as the input arm. The input arm may be placed between the first rocker arm and the second rocker arm in an axial direction of the same axis. Generally, the first valve and the second valve are provided separately from each other, so the first rocker arm and the second rocker arm are also provided separately from each other. Accordingly, if the input arm is placed between the first rocker arm and the second rocker arm in the axial direction of the same axis as described above, a space between the first rocker arm and the second rocker arm can be used effectively. Further, in the valve device according to the above aspect, the control shaft may be driven in the axial direction. The input arm may include first helical spline teeth on an inner periphery of the input arm. The first rocker arm may include, on an inner periphery of the first rocker arm, second helical spline teeth in a direction opposite to a helical direction of the first helical spline teeth. The slider may include third helical spline teeth and fourth helical spline teeth on an outer periphery of the slider. The first helical spline teeth may mesh with the third helical spline teeth. The second helical spline teeth may mesh with the fourth helical spline teeth. In the above aspect, the first helical spline teeth and the second helical spline teeth are provided in opposite helical directions. Accordingly, when the control shaft is driven in the axial direction, the third helical spline teeth and the fourth helical spline teeth provided on the slider pivot the input arm and the first rocker arm in opposite directions, so that a relative angle between the input arm and the first rocker arm is changed. Further, since the first rocker arm and the second rocker arm are connected to each other via the torsion portion, the second rocker arm also pivots in the same direction as the first rocker arm at the same time. Hereby, a relative positional relationship between each of the first rocker arm and the second rocker arm and each of the first valve and the second valve is changed, which can change maximum lift amounts of the first valve and the second valve.

Further, in the valve device according to the above aspect, the first rocker arm, the second rocker arm, and the torsion portion may be provided as an integrated member. In the internal combustion engine provided with a plurality of cylinders, an arm assembly constituted by the first rocker arm, the second rocker arm, and the input arm may be provided for each of the plurality of cylinders. According to the above aspect, the arm assembly for one cylinder is configured such that the first rocker arm, the second rocker arm, and the torsion portion are formed as an integrated member, thereby making it possible to reduce the number of components constituting the arm assembly.

Further, in the valve device according to the above aspect, a minimum inside diameter of a hole of the second rocker arm through which the control shaft is passed may be larger than a maximum outside diameter of an outer periphery of the slider. According to the above aspect, after the input arm is axially aligned with the first rocker arm and the second rocker arm formed integrally, the slider is inserted from a second-rocker-arm side, and hereby, the first, second helical spline teeth can mesh with the third, fourth helical spline teeth, respectively. Accordingly, the slider can be assembled to the input arm and the first rocker arm without interfering with the second rocker arm while the first rocker arm and the second rocker arm are formed integrally. Further, in the valve device according to the above aspect, the first valve and the second valve may be intake valves. According to the above aspect, a desired timing difference in pivoting occurs between the first rocker arm and the second rocker arm, which causes a difference between opening and closing timings of the intake valves. This causes a desired swirl, thereby making it possible to improve combustion efficiency.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

The following describes a valve device of the present invention with reference to FIGS. 1 to 5.

Figure 1:
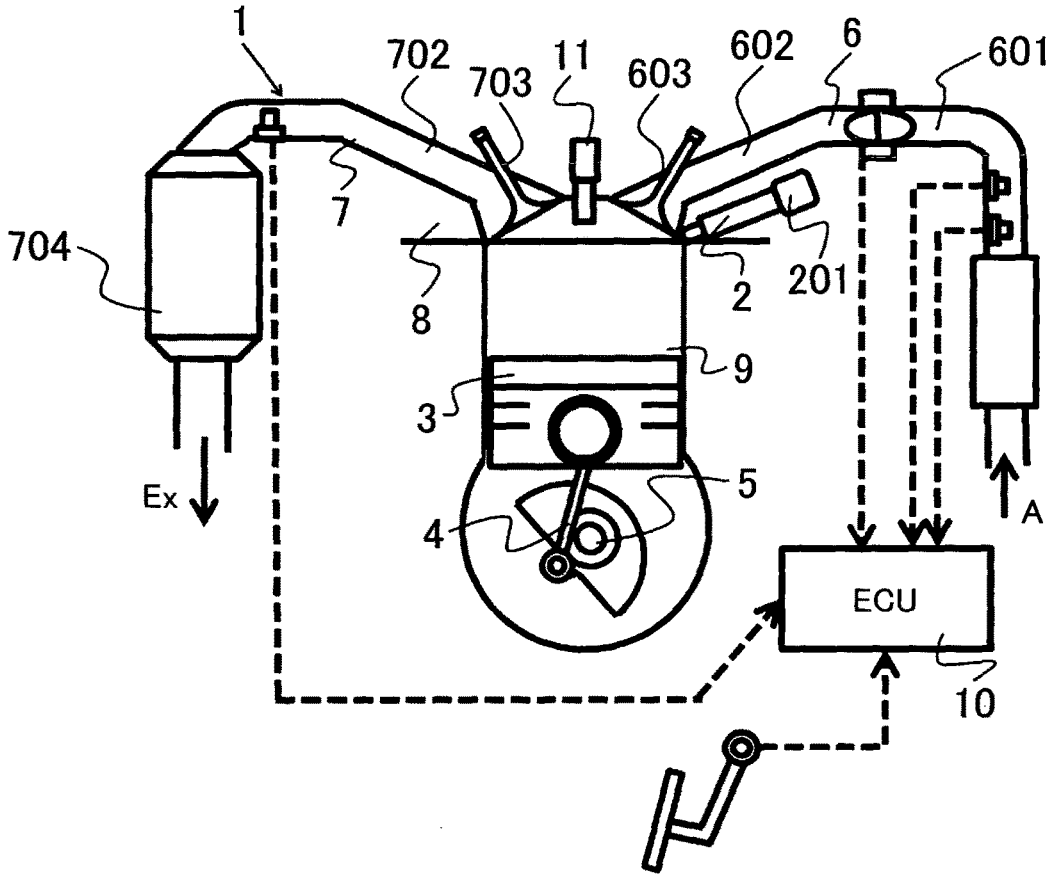
FIG. 1 is a view illustrating a system configuration of an embodiment of the present invention.

FIG. 1 is a view illustrating a system configuration of an embodiment of the present invention. As illustrated in FIG. 1, this system is an engine 1 including a cylinder direct-injection injector 2, and is configured to directly inject fuel into a cylinder 9, so as to generate a fuel/air mixture.

Figure 2:
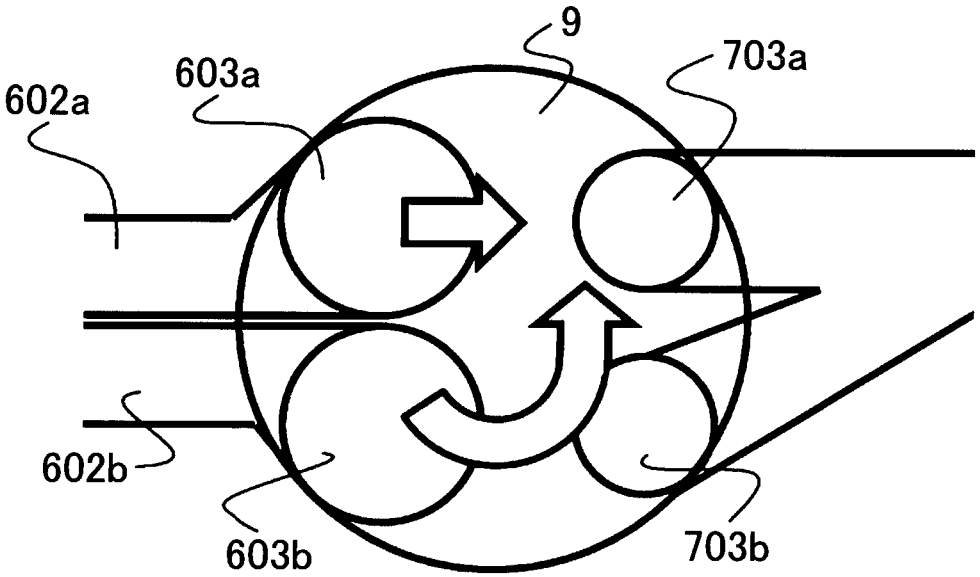
FIG. 2 is a view to describe a specific configuration around intake and exhaust ports in an internal combustion engine illustrated in FIG. 1.

A piston 3 is provided in the cylinder 9 of the engine 1, and the piston 3 reciprocates along with combustion of the fuel/air mixture. The reciprocating motion of the piston is transmitted to a crankshaft 5 via a connecting rod 4, so that the reciprocating motion is converted into a rotational motion herein. Then, the rotational motion is taken out as an output of the engine 1. As an air-intake system of the engine 1 according to the present embodiment, an intake passage 6, an intake manifold 601, and an intake port 602 formed in a cylinder head 8 are provided. The air-intake system of the engine 1 includes two intake ports 602*a*, 602*b* as illustrated in FIG. 2, and the intake ports 602*a*, 602*b* can be opened and closed by respective intake valves 603*a*, 603*b*. Further, the intake valves 603*a*, 603*b* are opened and closed according to pivoting of rocker arms 13*a*, 13*b* illustrated in FIG. 3. More information about each of the intake valves 603*a*, 603*b* and a variable valve device will be described later. In the meantime, as an exhaust system of the engine 1 according to the present embodiment, exhaust ports formed in the cylinder head 8, an exhaust manifold 702, and an exhaust passage 7 are provided. The engine 1 according to the present embodiment includes two exhaust ports (first and second exhaust ports) for one cylinder, and the exhaust ports can be opened and closed by respective exhaust valves (first and second exhaust valves) 703*a*, 703*b*.

The injector 2 is connected to a delivery pipe 201, so that fuel is supplied from the delivery pipe 201 thereto. The fuel directly injected to the cylinder 9 from the injector 2 forms a fuel/air mixture together with air A that is introduced into the cylinder 9 via the intake passage 6, the intake manifold 601, and the intake port 602. Note that an injection timing and an injection amount of the fuel injection from the injector 2 are adjusted by a computing process of an engine ECU 10 according to a load and an engine speed of the engine 1. An ignition plug (ignitor) 11 is disposed in the cylinder head 8. In a state where the fuel injected to the cylinder 9 from the injector 2 forms the fuel/air mixture together with the air A introduced into the cylinder 9, a compression stroke is performed and ignition of the ignition plug 11 is performed, so that the fuel is burned (an expansion stroke). A combustion pressure thereof is transmitted to the piston 3, so that the piston 3 hereby reciprocates. The fuel/air mixture after the burning becomes an exhaust gas Ex, and along with an opening operation of the exhaust valves 703*a*, 703*b*, the exhaust gas Ex is exhausted to the exhaust manifold 702 via the exhaust ports (an exhaust stroke). The exhaust gas Ex is then purified by a catalytic converter 704 provided on a downstream side of the exhaust manifold 702, and then emitted into an atmospheric air through the exhaust passage 7.

FIG. 2 illustrates a specific configuration around the intake and exhaust ports in the internal combustion engine illustrated in FIG. 1. As described above, each cylinder includes the intake valves 603*a*, 603*b* respectively corresponding to two intake ports 602*a*, 602*b*. When a difference in lift timing occurs between the intake valves 603*a*, 603*b*, a difference also occurs between intake timings of the air flowing into the cylinder from the intake ports 602*a*, 602*b*, so that a swirl occurs. The swirl promotes mixing of the air with the fuel, thereby increasing combustion efficiency. A main purpose of the present embodiment is to obtain a lift timing difference between the intake valves to cause the swirl with a simple configuration. However, its specific configuration will be described later. Next will be described a specific configuration of the variable valve device according to the embodiment of the present invention, with reference to FIGS. 3 to 5.

Figure 3:
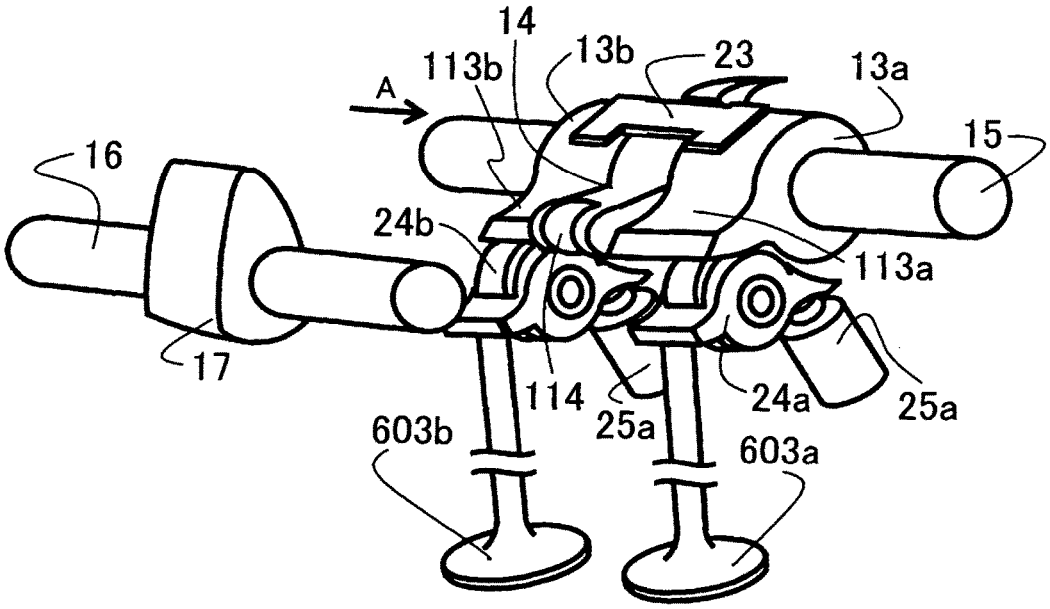
FIG. 3 is a view to describe a schematic configuration of a valve device according to the embodiment of the present invention.

FIG. 3 is a perspective view of the variable valve device according to the embodiment of the present invention. The variable valve device in FIG. 3 is provided with a control shaft 15, rocker arms 13 (a first rocker arm 13*a*, a second rocker arm 13*b*), and an arm assembly (not shown) constituted by a roller arm 14 as a main component, and these members are provided for each cylinder. Further, the control shaft 15 is placed in parallel to a camshaft 16, so as to be supported in a rotatable manner and in a linearly movable manner in an axial direction. Also, the control shaft 15 is driven by an actuator (not shown) in the axial direction. Further, the first rocker arm 13*a* and the second rocker arm

13*b* are formed as an integrated member via a connecting portion 23. As illustrated in FIG. 3, since the roller arm 14 is provided between the first rocker arm 13*a* and the second rocker arm 13*b* when viewed from the axial direction of the control shaft 15, the first rocker arm 13*a* and the second rocker arm 13*b* are placed so as to be separated from each other via the connecting portion 23. Here, in the present embodiment, the roller arm 14 and the connecting portion 23 correspond to an input arm and a torsion portion in the present invention, respectively. Rigidity, a material, and a dimension of the connecting portion 23 can be changed appropriately so as to generate a desired swirl flow.

Figure 4:
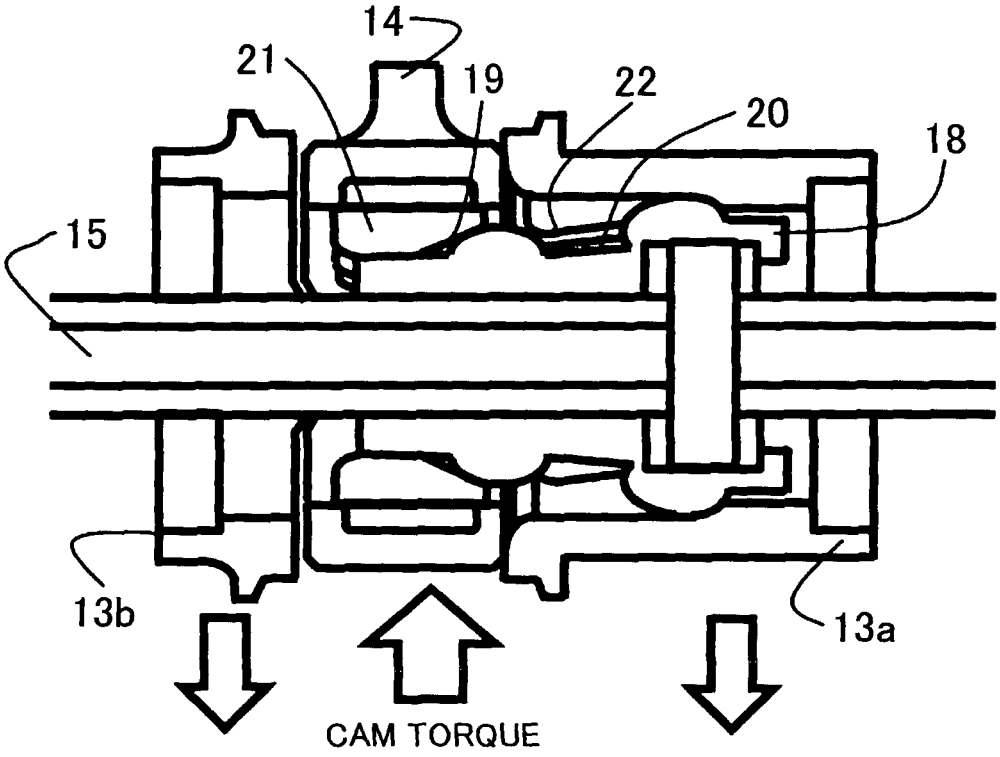
FIG. 4 is a view illustrating an internal structure of an arm assembly according to the embodiment of the present invention.
Figure 5:
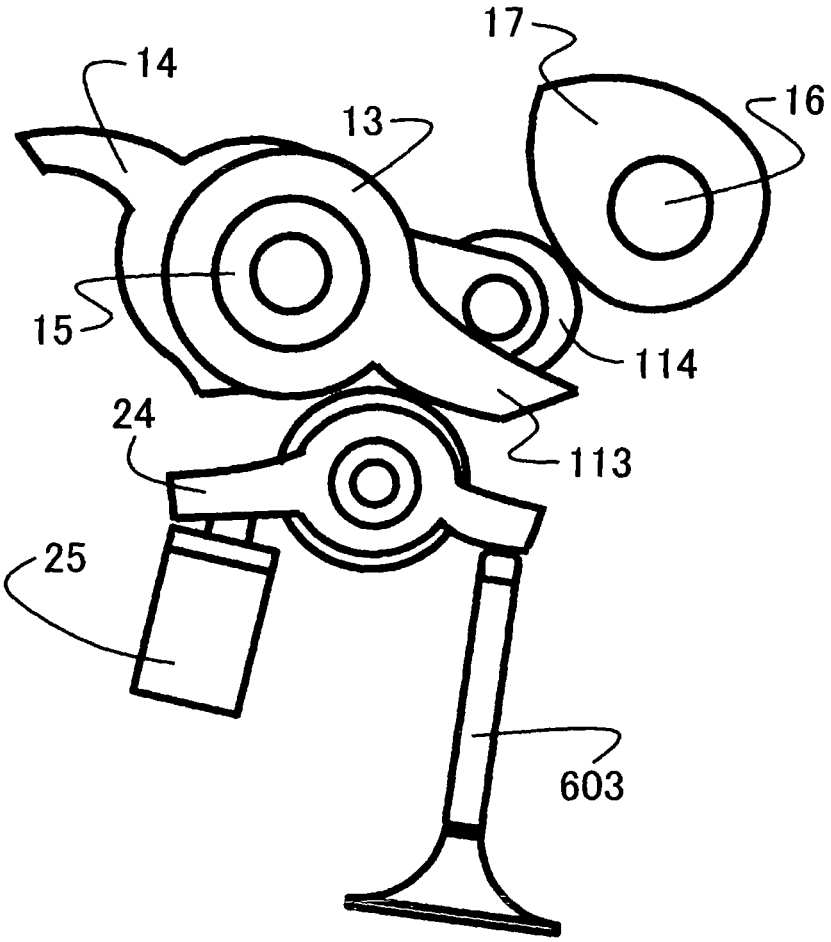
FIG. 5 is a view of the valve device according to the embodiment of the present invention, when viewed from a direction of an arrow A in FIG. 3.

The arm assembly does not move in the axial direction of the control shaft 15, but swings in a rotation direction around an axial center of the control shaft 15. The arm assembly can shift rotational phases of the roller arm 14 and the rocker arms 13*a*, 13*b* from each other, that is, relative angles between the roller arm 14 and the rocker arms 13*a*, 13*b* are variable. The roller arm 14 includes a cam struck portion 114 constituted by a roller and configured such that a cam torque of the cam 17 is input thereto. The rocker arms 13*a*, 13*b* include valve striking portions 113*a*, 113*b*. Further, in the present embodiment, roller rocker arms 24*a*, 24*b* that take a role to transmit a cam torque to the intake valves 603*a*, 603*b* from the valve striking portions 113*a*, 113*b* are provided. Lash adjusters 25*a*, 25*b* are provided in the roller rocker arms 24*a*, 24*b*, so that clearances between the valve striking portions 113*a*, 113*b*, the roller rocker arms 24*a*, 24*b*, and the intake valves 603*a*, 603*b* are adjusted to zero automatically. Further, the arm assembly is configured such that the first rocker arm 13*a*, the second rocker arm 13*b*, and the connecting portion 23 are formed as an integrated member, thereby making it possible to reduce the number of components of the arm assembly itself. FIG. 4 illustrates an internal structure of the arm assembly according to the present embodiment. A slider 18 is fixed to the control shaft 15. First helical spline teeth 19 are provided on an inner periphery of the roller arm 14, and second helical spline teeth 20 in a direction opposite to a helical direction of the first helical spline teeth 19 are provided on an inner periphery of the first rocker arm 13*a*. Further, third helical spline teeth 21 meshing with the first helical spline teeth 19 of the roller arm 14 and fourth helical spline teeth 22 meshing with the second helical spline teeth 20 of the first rocker arm 13*a* are provided on an outer periphery of the slider 18. When the control shaft 15 is driven in the axial direction, the slider 18 is driven in the axial direction just by the same amount. When the slider 18 is driven in the axial direction, the roller arm 14 and the rocker arms 13*a*, 13*b* accordingly pivot in opposite directions around the axial center of the control shaft 15 (the same axis), so that the relative angles between the roller arm 14 and the rocker arms 13*a*, 13*b* are changed. FIG. 5 is a view of the variable valve device according to the present embodiment, when viewed from a direction of an arrow A in FIG. 3. An output of the engine is transmitted from the crankshaft 5 (illustrated in FIG. 1) to the camshaft 16 via a power transmission member (not shown), so that the camshaft 16 pivots. When the camshaft 16 pivots, the cam 17 transmits the output (cam torque) of the engine to the cam struck portion 114 of the roller arm 14. The cam torque thus transmitted to the roller arm 14 is transmitted to the rocker arms 13*a*, 13*b* via the slider 18. The rocker arms 13*a*, 13*b* to which the cam torque is transmitted pivot, so as to transmit the cam torque to the roller rocker arms 24*a*, 24*b* via the valve striking portions 113*a*, 113*b*. When the cam torque is transmitted to the roller rocker arms 24*a*, 24*b*, the roller rocker arms 24*a*, 24*b* pivot, and along with this, the intake valves 603*a*, 603*b* are lifted (opened). Further, while that part of the cam 17 which does not have a profile makes contact with the cam struck portion 114 of the roller arm 14, the intake valves 603*a*, 603*b* are biased by valve springs (not shown) in a valve closing direction. When the relative angles between the roller arm 14 and the rocker arms 13*a*, 13*b* are changed as described above, relative positions between the rocker arms 13*a*, 13*b* and the roller rocker arms 24*a*, 24*b* are changed. Along with the change of the relative positions, maximum lift amounts of the intake valves 603*a*, 603*b* are changed. Here, with reference to FIG. 4, the following describes features of the present embodiment. In the present embodiment, the slider 18 meshes with the first helical spline teeth 19 provided on the inner periphery of the roller arm 14 and with the second helical spline teeth 20 provided on the inner periphery of the first rocker arm 13*a*, but does not mesh with the second rocker arm 13*b*. Accordingly, the cam torque transmitted to the roller arm 14 is not directly transmitted to the second rocker arm 13*b*, but is first transmitted only to the first rocker arm 13*a*. As described above, the first rocker arm 13*a* and the second rocker arm 13*b* are formed as an integrated member via the connecting portion 23, so the cam torque thus transmitted to the first rocker arm 13*a* is transmitted to the second rocker arm 13*b* via the connecting portion 23.

Further, a minimum inside diameter of that hole of the second rocker arm 13*b* through which the shaft is passed is formed to be larger than a maximum outside diameter of the outer periphery of the slider 18 fixed to the control shaft 15. Hereby, at the time of assembling, the roller arm 14 is axially aligned with the first rocker arm 13*a* and the second rocker arm 13*b* formed as an integrated member, and the shaft is inserted therethrough. Then, the slider 18 is inserted from a side of the second rocker arm 13*b* that does not mesh with the slider 18 so that the first, second helical spline teeth 19, 20 mesh with the third, fourth helical spline teeth 21, 22, respectively. Hereby, the slider 18 can be assembled to the roller arm 14 and the first rocker arm 13*a* without interfering with the second rocker arm 13*b* while the first rocker arm 13*a* and the second rocker arm 13*b* are formed integrally.

As described above, in the present embodiment, the first, second rocker arms 13*a*, 13*b* thus formed integrally are configured such that the roller arm 14 is connected to the first rocker arm 13*a* in a power transmittable manner via the slider 18, but the roller arm 14 is not directly connected to the second rocker arm 13*b*. Hereby, the cam torque transmitted to the first rocker arm 13*a* is sequentially transmitted to the second rocker arm 13*b* with torsion of a frame body of the rocker arm 13 including the connecting portion 23. Accordingly, a timing difference in pivoting occurs between the first, second rocker arms 13*a*, 13*b*, which causes a difference between respective lift timings of the intake valves 603*a*, 603*b*. This makes it possible to cause a desired lift timing difference with a simple structure without any components such as shims for positioning. Further, since the roller arm 14 is provided between the first rocker arm 13*a* and the second rocker arm 13*b* when viewed from the axial direction of the control shaft 15, the first rocker arm 13*a* and the second rocker arm 13*b* are placed so as to be separated from each other via the connecting portion 23. Hereby, in comparison with a case where the first rocker arm 13*a* and the second rocker arm 13*b* are placed so as to be close to each other, it is possible to increase design flexibility in terms of changes of rigidity, a material, and a dimension for generating a desired swirl flow more appropriately. Further, by causing a desired lift timing difference between a plurality of intake valves with a simple structure, a difference occurs between opening and closing timings of the intake valves, thereby making it possible to generate a desired swirl. As a result, improvement of fuel efficiency can be expected.

Further, the arm assembly configured such that the first rocker arm 13*a*, the second rocker arm 13*b*, and the connecting portion 23 are formed as an integrated member is provided for each cylinder. Accordingly, in comparison with a case where the first rocker arm 13*a*, the second rocker arm 13*b*, and the connecting portion 23 are formed separately, it is possible to reduce the number of components of the arm assembly, and to simplify steps of positioning the components for each cylinder so as to obtain a desired lift timing.

Further, the minimum inside diameter of that hole of the second rocker arm 13*b* through which the shaft is passed is formed to be larger than the maximum outside diameter of the outer periphery of the slider 18. This makes it possible to assemble the slider 18 even if the first, second rocker arms 13*a*, 13*b* are formed as an integrated member.

The above embodiment is merely one embodiment, and can be modified variously. For example, the embodiment of the present invention exemplifies a case where one cylinder is provided with two rocker arms, two intake valves, and two intake ports. However, the present invention is not limited to this, and the number of each of these members may be three or more. Further, it is not necessary to form all the plurality of rocker arms as an integrated member.

Further, the above embodiment deals with an embodiment related to a variable valve device provided on an intake side. However, the present invention is not limited to this, and the variable valve device may be provided on an exhaust side.

Further, the above embodiment deals with an embodiment in which the connecting portion 23 is provided integrally with the first rocker arm 13*a* and the second rocker arm 13*b*. However, the present invention is not limited to this, and the connecting portion 23 may be formed separately from both of or either one of the first rocker arm 13*a* and the second rocker arm 13*b*. That is, as long as the connecting portion 23 is configured to cause torsion, the connecting portion 23 may have a dimension defined so that its rigidity is lower than the first rocker arm 13*a* and the second rocker arm 13*b*, or may be made of a material having a low rigidity.

The invention claimed is:

1. A valve device for an internal combustion engine, the internal combustion engine including a plurality of cylinders, the valve device comprising:

a camshaft;

a cam provided in the camshaft;

a control shaft provided as a shaft different from the camshaft, the control shaft being placed in parallel with the camshaft;

an input arm to which a cam torque of the cam is transmitted;

a first rocker arm;

a second rocker arm;

a first valve configured to be opened and closed along with pivoting of the first rocker arm;

a second valve placed in a same cylinder as the first valve is placed, the second valve configured to be opened and closed along with pivoting of the second rocker arm; and a slider configured to allow the input arm to be supported by the control shaft, the slider configured to support the first rocker arm in a power transmittable manner such that the cam torque transmitted to the input arm is transmitted to the first rocker arm, wherein:

the first rocker arm and the second rocker arm are connected by a torsion portion such that the cam torque transmitted to the first rocker arm is transmitted to the second rocker arm via the torsion portion;

the first rocker arm, the second rocker arm, and the torsion portion are provided as an integrated member;

an arm assembly constituted by the first rocker arm, the second rocker arm, and the input arm are provided for each of the plurality of cylinders; and a minimum inside diameter of a hole of the second rocker arm through which the control shaft is passed is larger than a maximum outside diameter of an outer periphery of the slider.

2. The valve device according to claim 1, wherein:

the first rocker arm and the second rocker arm are provided in a same axis as the input arm; and the input arm is placed between the first rocker arm and the second rocker arm in an axial direction of the same axis.

3. The valve device according to claim 1, wherein:

the control shaft is driven in an axial direction;

the input arm includes first helical spline teeth on an inner periphery of the input arm;

the first rocker arm includes, on an inner periphery of the first rocker arm, second helical spline teeth in a direction opposite to a helical direction of the first helical spline teeth;

the slider includes third helical spline teeth and fourth helical spline teeth on an outer periphery of the slider;

the first helical spline teeth mesh with the third helical spline teeth; and the second helical spline teeth mesh with the fourth helical spline teeth.

4. The valve device according to claim 1, wherein the first valve and the second valve are intake valves.

* * * * *